United States Patent [19]

Golicz

[11] Patent Number: 4,674,375

[45] Date of Patent: Jun. 23, 1987

[54] MECHANISM FOR SLITTING AND MERGING SHEETS

[75] Inventor: Roman M. Golicz, Clinton, Conn.

[73] Assignee: G.B.R. Ltd., Chester, Conn.

[21] Appl. No.: 853,622

[22] Filed: Apr. 18, 1986

Related U.S. Application Data

[63] Continuation of Ser. No. 657,139, Oct. 3, 1984, abandoned.

[51] Int. Cl.[4] ..... B65H 29/22

[52] U.S. Cl. ..... 83/91; 83/84; 83/156; 270/58; 271/314

[58] Field of Search ..... 271/250, 251, 314, 299; 198/420, 422, 423; 83/156, 84, 436, 440, 824–826, 407, 440.1, 438, 91, 90; 226/184; 270/58, 59

[56] References Cited

U.S. PATENT DOCUMENTS

| | | | |
|---|---|---|---|
| 708,958 | 9/1902 | Cowan | 271/299 X |
| 3,029,655 | 4/1962 | Morrow | 198/843 X |
| 3,178,170 | 4/1965 | Walch et al. | 270/58 |
| 3,929,327 | 12/1975 | Olson | 226/184 X |
| 4,280,690 | 7/1981 | Hill | 198/420 X |
| 4,381,107 | 4/1983 | Armiger | 270/58 |

*Primary Examiner*—James M. Meister

*Attorney, Agent, or Firm*—Stoll, Wilkie, Previto & Hoffman

[57] ABSTRACT

A mechanism for slitting a sheet into a number of individual smaller sheets and thereafter merging the smaller sheets together and mechanism for adjusting the angle of merge.

15 Claims, 5 Drawing Figures

MECHANISM FOR SLITTING AND MERGING SHEETS

This application is a continuation of pending U.S. application Ser. No. 657,139, filed Oct. 3, 1984, now abandoned.

DESCRIPTION

The present invention is directed to a mechanism for slitting a large sheet into separate smaller sheets and merging the smaller sheets together so that they may be packaged or otherwise used as a unit.

In handling and packaging of paper and other similar articles, such as telephone bills, which comprise a number of single sheets, it has been discovered that the printed material appearing on these single sheets may be printed on a large single sheet which is then slit into smaller sheets. The smaller sheets are then consolidated or merged together in order to produce a composite formed of single sheets, such as are used to prepare multi-paged telephone bills, reports, and the like.

The present invention has for one of its objects the provision of an improved mechanism for slitting a large sheet into a number of individual smaller sheets and thereafter merging the smaller sheets into a substantially unitary stack.

Another object of the present invention is the provision of an improved mechanism whereby the process of slitting and merging is performed automatically.

Other and further objects of the invention will be obvious upon an understanding of the illustrative embodiment about to be described, or will be indicated in the appended claims, and various advantages not referred to herein will occur to one skilled in the art upon employment of the invention in practice.

A preferred embodiment of the invention has been chosen for purposes of illustration and description and is shown in the accompanying drawings forming a part of the specification, wherein.

Figure 1:
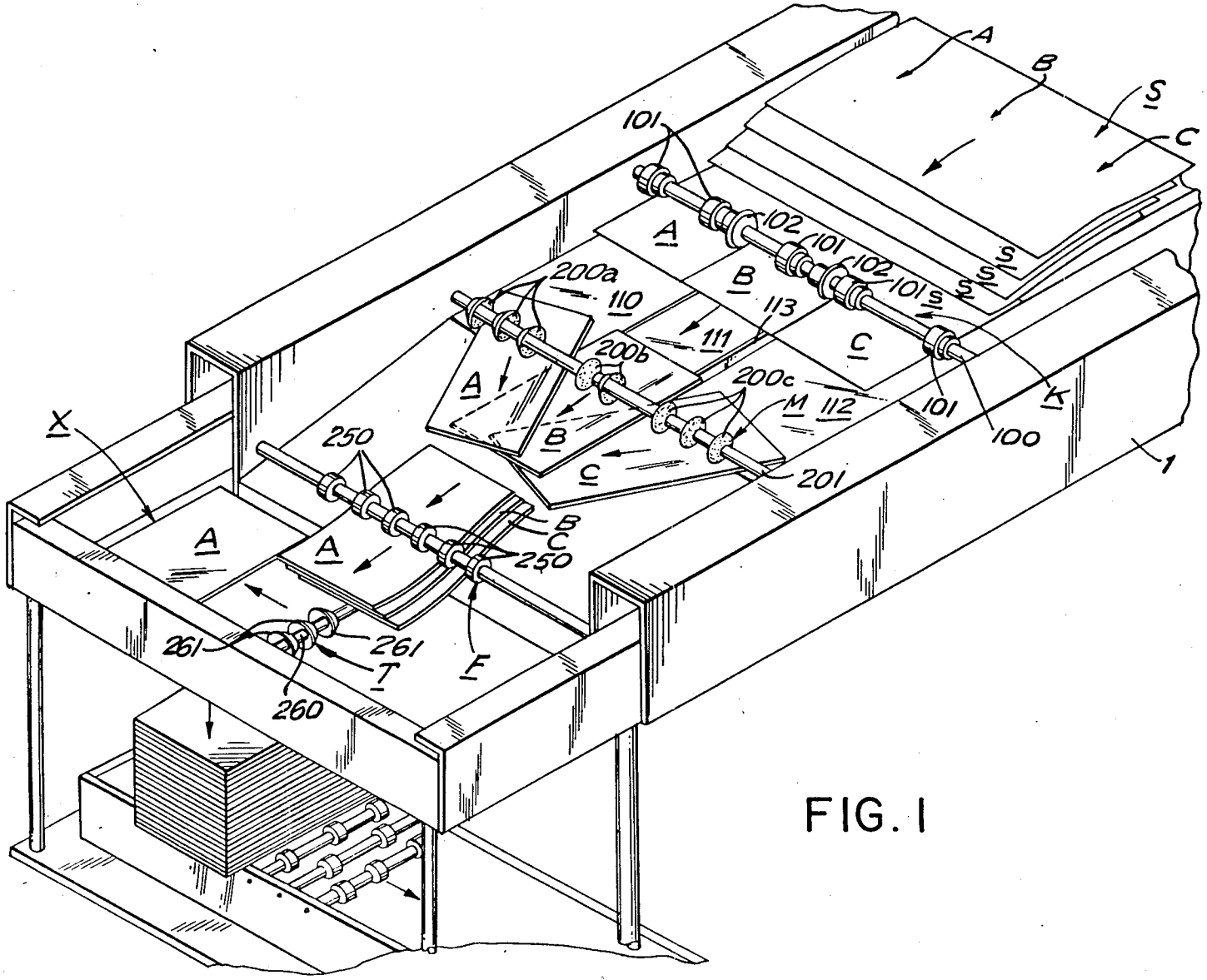
FIG. 1 is a perspective view showing the mechanism of the present invention.
Figure 2:
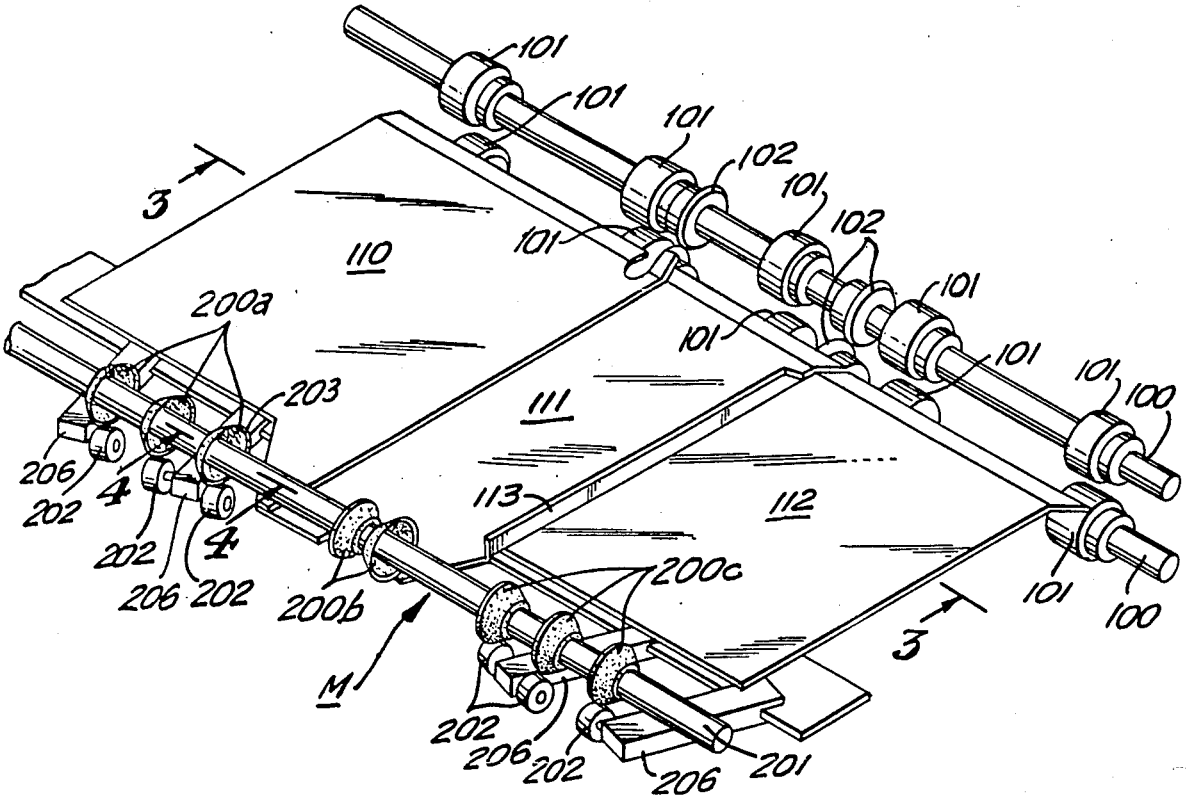
FIG. 2 is a perspective view of a detail of the slitting and merging assemblies of the present invention.
Figure 3:
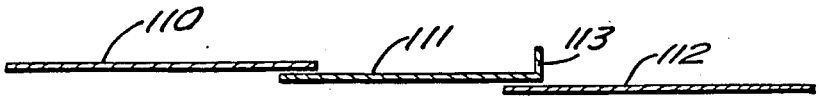
FIG. 3 is a sectional view taken along line 3—3 of FIG. 2.

Referring to the drawings and more particularly to FIG. 1, the present invention comprises a frame 1 having means (not shown) for feeding a plurality of composite sheets S to a slitting assembly K which slits each sheet S to form three smaller sheets A, B and C, with sheets A and C being at the ends and sheet B being interposed therebetween. The slit sheets A, B and C are then moved to a merging assembly M which merges the slit sheets A, B and C together and moves them to a feed assembly F which deposits them on a take-off assembly T which in turn will move the merged sheets A, B and C to a stacker assembly X (not shown in detail).

The composite sheet S is comprised of a plurality of areas A, B and C which have printed thereon information and data, such as telephone calls made. The composite sheet S is slit into smaller sheets A, B and C and the sheets A, B and C are merged together so that the data on the smaller slit sheets A, B and C will preferably be in a particular order, such as in chronological order.

Slitting assembly K consists of a pair of superimposed shafts 100 journalled in the frame 1 and equipped with opposed precision ground feed rollers 101 for moving the sheet S along. A plurality of hardened steel, split rotary knives 102 on each shaft 100 perform a scissor-like cutting action (slitting) and work together to slit the sheets S into smaller sheets A, B and C. The slit sheets A, B and C are deposited on a plurality of superimposed guide plates 110, 111 and 112. The guide plates 110-112 may be adjustable vertically, as well as horizontally, by appropriate mechanisms (not shown) in order to guide the slit sheets A, B and C to the merger assembly M. The center guide plate 111 has an upstanding guard 113 to guide the center sheet B in a straight path, as will be more fully discussed hereinbelow.

The merger assembly M consists of a number of flexible cones **200*a*, 200*b* and 200*c* on a shaft 201 also journalled in frame 1. The cones 200*a* and 200*c* overlie angled, deforming rollers 202 which are mounted on adjustable arms 206. The flexible cones 200*a* and 200*c* at opposite ends of the shaft 201 face inwardly toward each other while center flexible cones 200*b* face away from each other and do not have any pressure rollers therebeneath. The end cones 200*a* and 200*c* are adapted to direct the end sheets A and C toward the center and the center cones 200*b*** are adapted to merely keep the center sheets B in a straight path without giving the sheets B any sidewise movement.

The amount of movement of the end slit sheets A and C toward the center is controlled by the amount of pressure applied to cones **200*a* and 200*c* by rollers 202 therebeneath. By applying more or less pressure, the cones 200*a* and 200*c* are able to move the slit sheets A and C toward the center to a greater or lesser degree. The pressure rollers 202 are adjustable with respect to the cones 200*a* and 200*c* in order to permit the compression of cones 200*a* and 200*c*** to be adjusted thereby adjusting the amount of angular movement to be imposed on the end slit sheets A and B.

Figure 4:
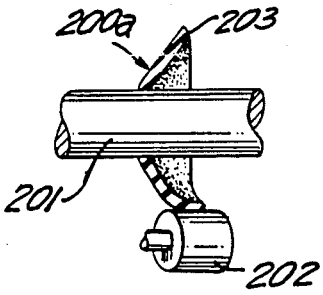
FIG. 4 is a sectional view taken along line 4—4 of FIG. 2.
Figure 5:
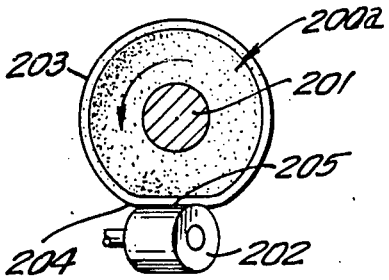
FIG. 5 is an end view of the parts shown in FIG. 4.

Merging of the end sheets A and C is based on controlled deformation of the flexible cones **200*a* and 200*c*. As shown in FIGS. 4 and 5, the rim 203 of each flexible cone 200*a* (for example) in a non-deformed state, when rotated, behaves in a manner similar to a wheel. Any point on the rim 203 travels in the same plane as the rest of the rim. However, if the rim 203 of the cone 200*a* is deformed, and the cone is rotated, the non-deformed part of the rim travels in one plane while the deformed part will travel in a plane 90° thereto. Hence, any point on the periphery of the rim 203 of the cone 200*a*** will change the plane of travel beginning at the point of depression and will revert to the original plane of travel at the end of the deformation.

Controlling the deformation of cones **200*a* and 200*c* can be accomplished in various ways, the preferred one of which is with the use of a bearing roller 202 mounted beneath the cones at an angle equal to direction of merge. A slit sheet (for example, slit sheet A) inserted between deforming roller 202 and deformed cone 200*a* will force the sheet A to rotate in the plane of deformation. To eliminate this rotation but retain merging motion of the sheet A, two or more similarly deformed cones 200*a* are placed on the same shaft 201. The deformed portion of the cones 200*a*** performs two distinct actions during their rotation. First, the segment of each cone periphery between contact point and exit point does the pushing while the segment of each cone periphery between exit and re-entry point does the pulling. Although both the contact areas are the same, the forces exerted are not. The resultant merging forces are the ones exerted by the push and drive effects of the cone wall in the angle direction of merge. The pull forces represented by elasticity of cone material and wiping effect may be ignored.

Hence, a sheet entered between two or more cones 200*a* acting in the same direction and deforming rollers therebeneath will be propelled in the direction of and at speed equal to a maximum speed of a point travelling on the deformed periphery 203 of the cones between point of entry 204 and point of exit 205 (FIG. 5).

To merge, or superimpose, the two end slit sheets A and C, cones 200*a* and 200*b* are placed on the common shaft facing in opposite directions. The opposing cones 200*a* and 200*c* will drive their respective sheets A and C toward the center. By deflecting the adjoining edge of the merging sheets to overlap each other, the sequence of superimposition can be controlled.

When more than two sheets are to be merged, various combination of cones and deforming rollers can be used such as, non-deformed cones 200*b*, placed on the same shaft 201 between deformed cones 200*a* and 200*c* facing each other will force the center sheet B to continue to travel in a straight path and the end sheets A and C to travel toward the center to form a merged stack.

Since the plates 110–112 are superimposed over each other, the sheets A, B and C will be merged in superimposed relationship to each other. The guard rail 113 on the guide plate 111 helps in monitoring the center sheet travel in a straight path. The superimposed sheets A, B and C are then fed by the feed roller assembly F having the feed rollers 250 thereon to a take-off station T which is provided with a take-off shaft 260 and flexible cones 261 at right angles to the original line of travel of sheets A, B and C so that each group of merged sheets A, B and C may be moved immediately away in order to make room for a new group of merged sheets A, B and C. These may be moved to a stacking assembly X which is adapted to be lowered to move the assembled sheets to an assembly point below the frame F.

It will thus be seen that the present invention provides an improved mechanism for slitting a sheet into a number of individual smaller sheets and thereafter merging the smaller sheets together and which permits automatic slitting and merging of the sheets and which also permits adjustments of the angle of merge.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A mechanism comprising a straight shaft, a plurality of resilient cones on said shaft, said cones being in axial alignment with each other, means for depressing the rims of said resilient cones, means for moving a sheet between said resilient cones and said depressing means wherby said sheet will be diverted from its path at an angle thereto, a first group of said cones face in one direction and a second group of cones face in the opposite direction, said depressing means comprising rollers opposite and adapted to apply pressure to each of said cones said rollers being adjustable relative to the cones to permit the amount of cone rim depression to be adjusted, whereby the angle of diversion of said sheet from its path may be adjusted.

2. A mechanism as claimed in claim 1 wherein said depressing means are adjustable transverse of the cone.

3. A mechanism as claimed in claim 2 wherein said depressing means are rollers underlying the cone.

4. A mechanism as claimed in claim 3 wherein said two groups of cones face toward each other in order to divert the paths of sheets passing therebeneath toward each other.

5. A mechanism as claimed in claim 4 wherein a third group of cones are interposed between said first and second group of cones to move a sheet without diverting its path.

6. A mechanism as claimed in claim 5 wherein said third group of cones are devoid of depressing means therebeneath.

7. A mechanism as claimed in claim 6 wherein slitter means are provided to slit a sheet into smaller sheets and for feeding said smaller sheets to said cones.

8. A mechanism as claimed in claim 7 wherein said sheets are fed to said cones and are merged in superimposed relationship to each other.

9. A mechanism as claimed in claim 8 wherein guide plates are provided between said slitter means and said cones for directing the slit sheets to said cones.

10. A mechanism as claimed in claim 9 wherein adjacent guide plates are in planar superimposed relationship to each other.

11. A mechanism as claimed in claim 10 wherein said guide plates are adjustable vertically and horizontally.

12. A mechanism as claimed in claim 11 wherein the center guide plate has an upstanding guide rail.

13. A mechanism as claimed in claim 12 wherein said slitter means comprises rotating knives and feed rollers mounted on a rotatable shaft.

14. A mechanism as claimed in claim 13 wherein take-off means are provided to move the merged sheets to a removal mechanism.

15. A mechanism as claimed in claim 14 wherein said removal mechanism moves the sheets at right angles to the take-off means.

* * * * *